US006116588A

United States Patent [19]

Yamane

[11] Patent Number: 6,116,588

[45] Date of Patent: Sep. 12, 2000

[54] CLAMPING DEVICE

[75] Inventor: Takeshi Yamane, Okayama, Japan

[73] Assignee: Trusco Nakayama Corporation, Higashiosaka, Japan

[21] Appl. No.: 09/315,047

[22] Filed: May 20, 1999

[51] Int. Cl.[7] ..... B25B 5/12

[52] U.S. Cl. ..... 269/228; 269/236; 269/201; 269/196

[58] Field of Search ..... 269/228, 236, 269/196, 201

[56] References Cited

U.S. PATENT DOCUMENTS

| | | | |
|---|---|---|---|
| 1,196,772 | 9/1916 | Gaede | 269/228 |
| 4,331,326 | 5/1982 | Strouss | 269/93 |

FOREIGN PATENT DOCUMENTS

| | | | |
|---|---|---|---|
| 54-3280 | 2/1979 | Japan . | |
| 0602361 | 4/1978 | U.S.S.R. | 269/228 |
| 821132 | 9/1959 | United Kingdom | 144/290 |

*Primary Examiner*—David A. Scherbel
*Assistant Examiner*—Lee Wilson
*Attorney, Agent, or Firm*—Wenderoth, Lind & Ponack, L.L.P.

[57] ABSTRACT

A clamping device includes a clamp arm (2), an operating lever (3) for pivotally operating the clamp arm (2), and a toggle mechanism (T) provided in connection with the operating lever (3). The clamp arm (2) is formed with a guide path (2*a*) that intersects a direction in which the clamp arm (2) pivots so that an output member (9) of the toggle mechanism (T) is guided along the guide path (2*a*). Accordingly, workpieces (W) of heights that can vary over a wide range of up to several centimeters can be firmly fixed without the necessity of performing a troublesome adjustment operation.

8 Claims, 7 Drawing Sheets

CLAMPING DEVICE

BACKGROUND OF THE INVENTION

The present invention relates to a clamping device that is capable of clamping a workpiece, particularly a component of automobiles, agricultural machines and implements and the like, in a compressed or tensioned state.

A known clamping device for use in fixing a workpiece, is disclosed in Japanese patent publication No. 54-3280. FIG. 5 shows a schematic view of such a clamping device.

In FIG. 5, numeral 1 denotes a base member 1, which has a fastening surface portion 1*a* and a pair of upright wall portions 1*b*. On the base member 1, a clamp arm 2 and an operating lever 3 are pivotally mounted via corresponding shafts 4 and 5, respectively.

The operating lever 3 is formed with a toggle mechanism T that is interlocked with the lever. Specifically, a link member 8 is mounted on part of the length of the operating lever 3 so that the link member is able to pivot around a shaft 7, and a lower end portion of this link member 8 is linked with part of the length of the clamp arm 2 via a shaft 9 that operates as an output member.

Numeral 8*a* denotes an engagement portion for restraining the link member 8 from unstrainedly pivoting around the shaft 9.

Numeral 10 denotes a pressing member mounted on the clamp arm 2 so that the pressing member is adjustable for its vertical position.

The above-mentioned clamping device is used with the fastening surface portion 1*a* of the base member 1 fastened to an appropriate base, and is operated in the following manner.

That is, when fixing a workpiece, the operating lever 3 is initially tilted in the direction of arrow f around the shaft 5, whereby the clamp arm 2 is lifted up via the toggle mechanism T. In this state, the workpiece is placed on a support base provided below the pressing member 10.

Next, the operating lever 3 is raised up with a relatively small operating force in the direction of f1 opposite to the previous direction f. By this operation, the clamp arm 2 is lowered and the pressing member 10 abuts against the workpiece. At this point of time, the operating lever 3 will not be displaced any further by a small operating force.

Subsequently, a greater operating force is applied to the operating lever 3 in the same direction, thereby displacing the lever in the same direction. By this operation, the output member 9 strongly pushes down the clamp arm 2 by the toggle effect of the toggle mechanism T, and the pressing member 10 strongly presses the workpiece against the support base.

According to the aforementioned prior art clamping device, the toggle effect provided by the toggle mechanism is significantly reduced even when the height of the workpiece to be fixed is varied slightly (about several millimeters), so that the workpiece cannot be firmly fixed.

If abrasion occurs in any contact portion of the members due to repetitive use or in a similar case, then the capability of fixing the workpiece is sharply reduced similar to the case where the height of the workpiece is reduced unless a correlation with the workpiece is corrected.

In order to cope with such a situation, it is required to frequently execute vertical position adjustment of the pressing member 10 relative to the workpiece, and this becomes a factor for which impairs the work efficiency.

SUMMARY OF THE INVENTION

The object of the present invention is to provide a clamping device capable of principally improving such an actual state of affairs.

In order to achieve the above object, there is provided a clamping device comprising, a clamp arm, an operating lever for pivotally operating the clamp arm, and a toggle mechanism provided in connection with the operating lever. The clamp arm is formed with a guide path that intersects a direction in which the clamp arm pivots so that an output member of the toggle mechanism is guided along the guide path.

If the operating lever is operated with a relatively small force, then the output member moves along the guide path, and the clamp arm pivots in connection with this movement. The pivoting of the clamp arm is restrained in a specified position associated with the workpiece. If a relatively great operating force is applied to the operating lever in this specified position, then the output member strongly presses the clamp arm by the toggle effect of the toggle mechanism.

According to the present invention constructed as described above, the workpieces of a height that is variable over a wide range of up to several centimeters can be firmly fixed without necessity of performing any troublesome adjustment work.

Even if abrasion occurs in the operative portions of the members due to repetitive use, the fixing force is not significantly reduced. Therefore, the device can be used without adjustment for a time much longer than in the prior art case.

Furthermore, according to the prior art device, the workpiece tends to be left unfixed for the reason that the operating lever is positioned in the same pivotal position regardless of whether the workpiece is in the fixed state or not when the operating lever is operated toward the fixation side. However, according to the present invention, when the workpiece is properly fixed, the operating lever is stopped partway along the guide path due to the steady contact between the output member and the guide path. On the other hand, when the work is not properly fixed, the operating lever pivots toward the fixation side (in the direction of f) without stopping partway along the guide path because of steady contact between the output member and the guide path. Therefore, whether the workpiece is properly fixed or not can be immediately sensed only by a manual touch.

The above-mentioned invention is implemented as follows.

That is, the clamp arm and the operating lever are pivotally mounted on specified portions of a base member, and the toggle mechanism may be provided with a first link member that is pivotally mounted on the base member so that the toggle mechanism pivots substantially concentrically with the operating lever and a second link member that is pivotally mounted on the operating lever. The link members are linked with each other via the output member so that the link members are able to pivot around the output member, and the link members and the output member are urged in a specified pivotal direction by an elastic means. According to this arrangement, the aforementioned effect is accurately obtained.

More preferably, when the second link member may receive a pressure force of not smaller than a specified magnitude from the output member, the second link member linked with the output member may retreat in a direction in which a pressure force is directed against an elastic force.

According to this arrangement, no excessive stress due to the toggle mechanism occurs in the components, so that the components are hard to get the permanent strain and the operation of the toggle mechanism becomes smooth.

DETAILED DESCRIPTION OF THE PREFERRED EMBODIMENTS

Figure 1A:
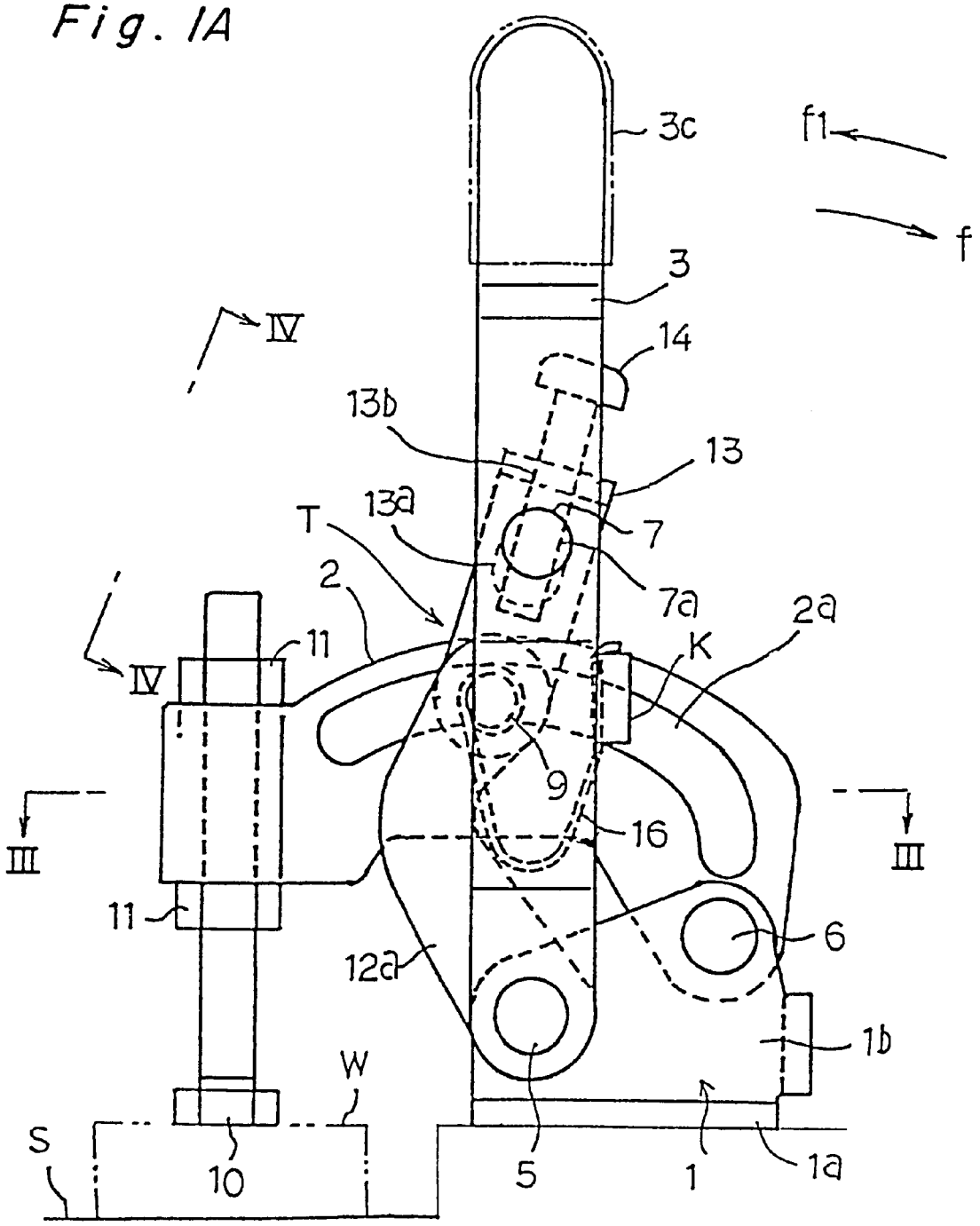
FIG. 1A is a side view of a clamping device according to the present invention showing a fixation state.

One embodiment of the present invention will be described below.

In FIGS. 1A to 4, portions that are substantially identical to those of the prior art example are denoted by the same reference numerals.

A clamp arm 2 is formed by connecting two plate members to each other and mounted via a shaft 6 with its one end portion inserted between a pair of upright wall portions 1*b* of a base member 1.

The clamp arm 2 is formed with a guide path 2*a* that intersects a direction in which the clamp arm pivots. This guide path 2*a*, which can be arbitrarily formed, is formed into an arc-shaped through hole according to the illustrated example.

A bolt 10 is employed as a pressing member. The bolt 10 is inserted through a vertical hole located at the forefront portion of the clamp arm 2 and fixed by nuts 11 so as to be adjustable in the vertical position.

The structure of the operating lever 3 will be explained below. A pair of plate members 3*a* and 3*b* that are bent in the center portions of the length thereof so as to have recess portions facing each other. The plate members 3*a* and 3*b* are positioned outside of the pair of upright wall portions 1*b* and mounted on the upright wall portions 1*b* by the shaft 5. An upper end portion 3*c* is covered with a resin material so as to serve as a grip portion. The reference character K denotes an engagement portion.

The operating lever 3 is provided with a toggle mechanism T that operates in connection with the lever. The toggle mechanism T is constructed as follows.

A pair of first link members 12*a* and 12*b* are mounted on the pair of upright wall portions 1*b* so that the first link members are able to pivot around the shaft 5, while a U-shaped second link member 13 is mounted on part of the length of the operating lever 3 via a shaft 7, which is inserted through an elongated hole 13*a* formed through the link member 13.

Figure 4:
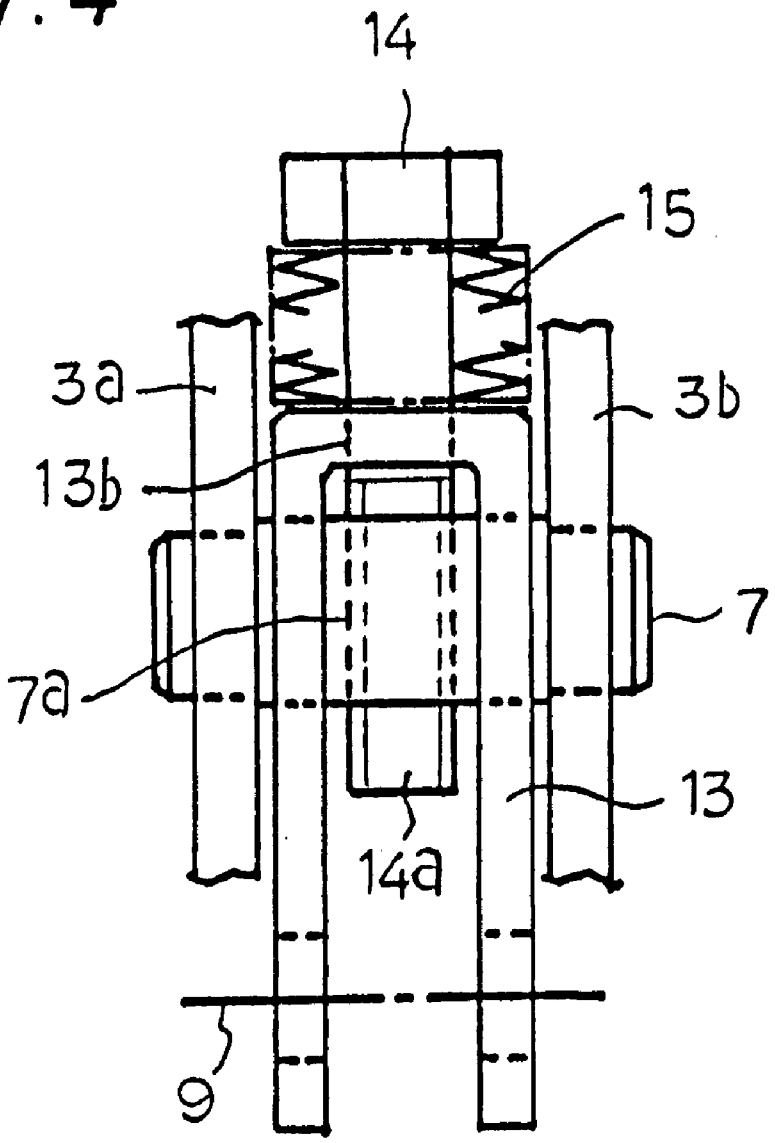
FIG. 4 is a view taken along line IV—IV in FIG. 1.
Figure 5:
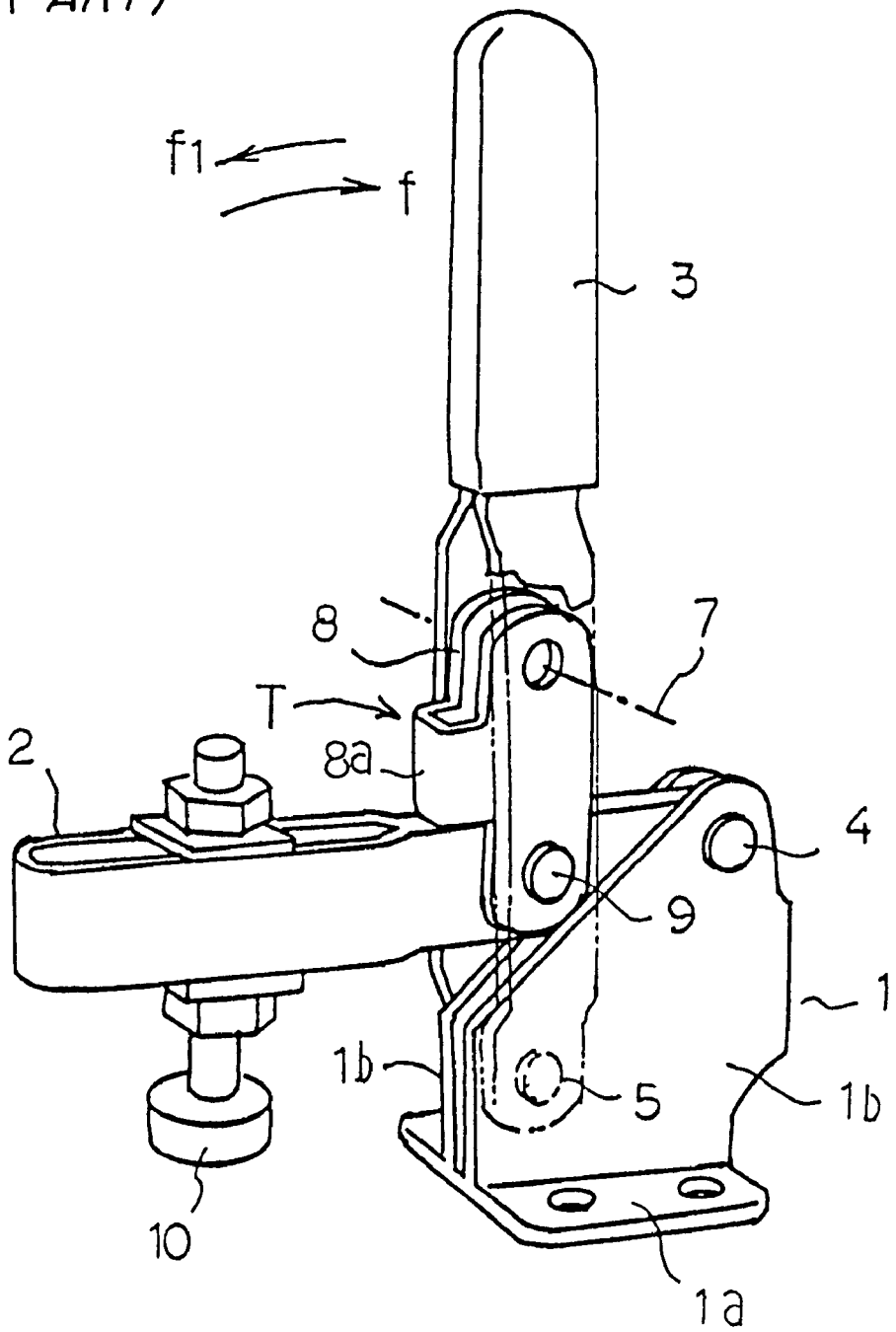
Fig. 5 (PRIOR ART)
FIG. 5 is a view of a prior art example.

A bolt 14 is inserted through a through hole 13*b* formed in a center portion of the second link member 13 as shown in FIG. 4. The bolt 14 is screwed into a threaded hole 7*a* formed in a portion in the direction of diameter of the shaft 7. Belleville springs 15 are mounted around a threaded portion 14*a* of the bolt 14 in a laminated and compressed state between the neck portion of the bolt 14 and the center portion of the second link member 13, so that the second link member 13 is pressed in the direction toward an output member 9 by the elastic force of the Belleville spring 15 so that the second link member 13 is able to retreat in the opposite direction.

Then, the first link members 12*a* and 12*b* and the second link member 13 are linked with each other via the output member 9 inserted through the guide path 2*a* so that both members are able to pivot around the output member 9.

In this case, a V-shaped spring 16 is mounted between the operating lever 3 and the output member 9, so that the elastic force of the V-shaped spring 16 makes the first link members 12*a* and 12*b* and the second link member 13 pivot around the respective shafts 5 and 6, thereby positioning the output member 9 in a specified position in front of the operating lever 3.

Figure 1B:
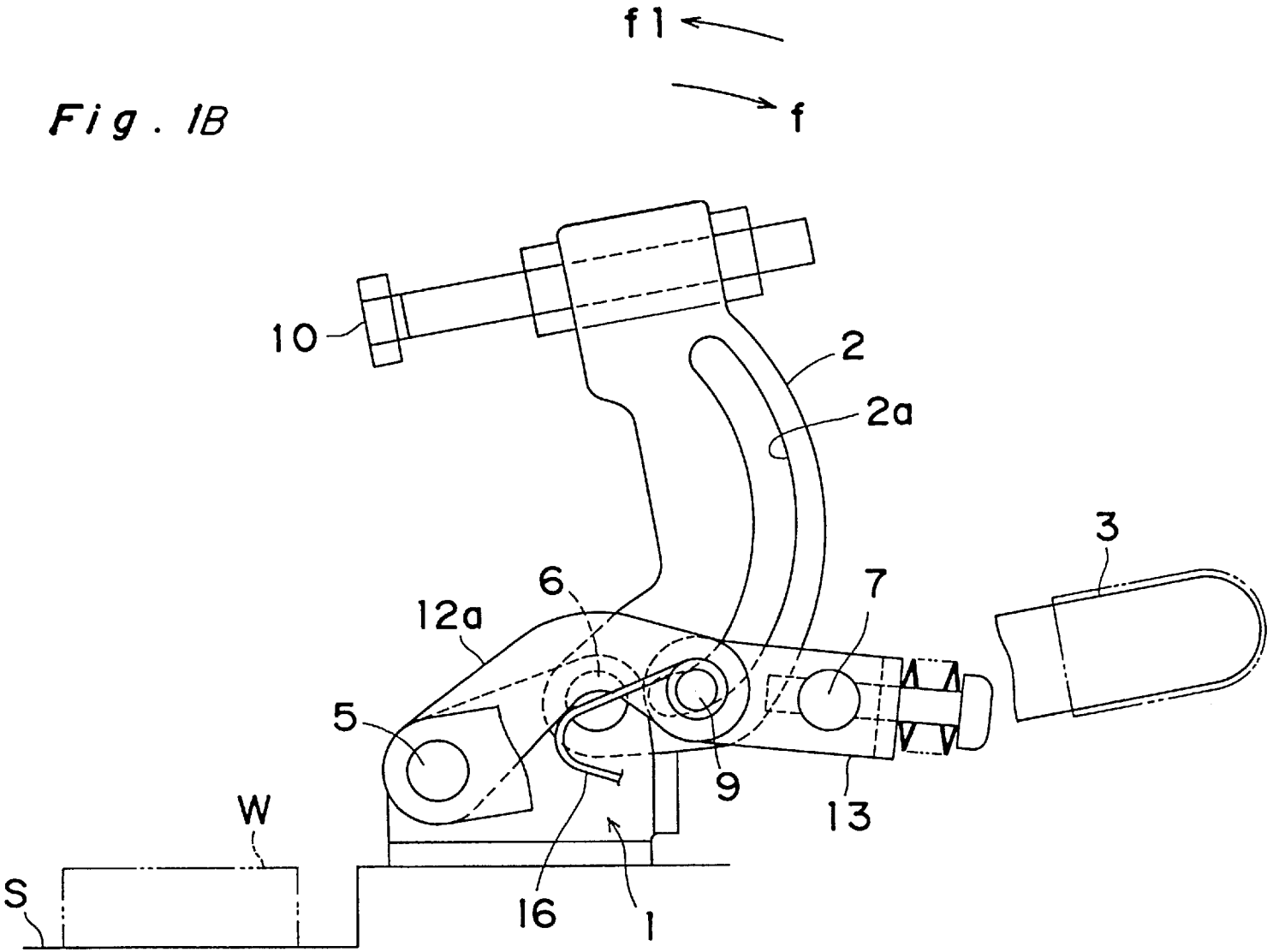
FIG. 1B is a side view of the clamping device of FIG. 1 showing a non-fixation state of the clamping device.
Figure 1C:
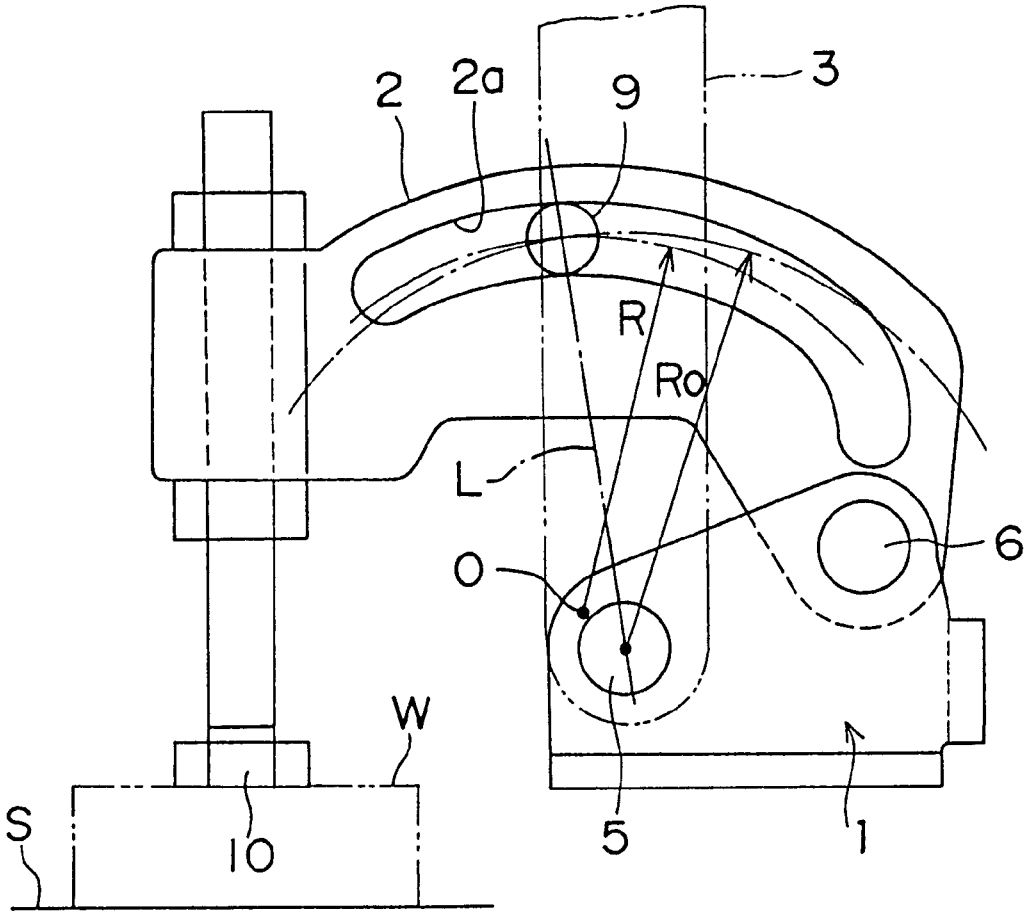
FIG. 1C is a side view of a clamp arm showing a shape of a guide path thereof.
Figure 2:
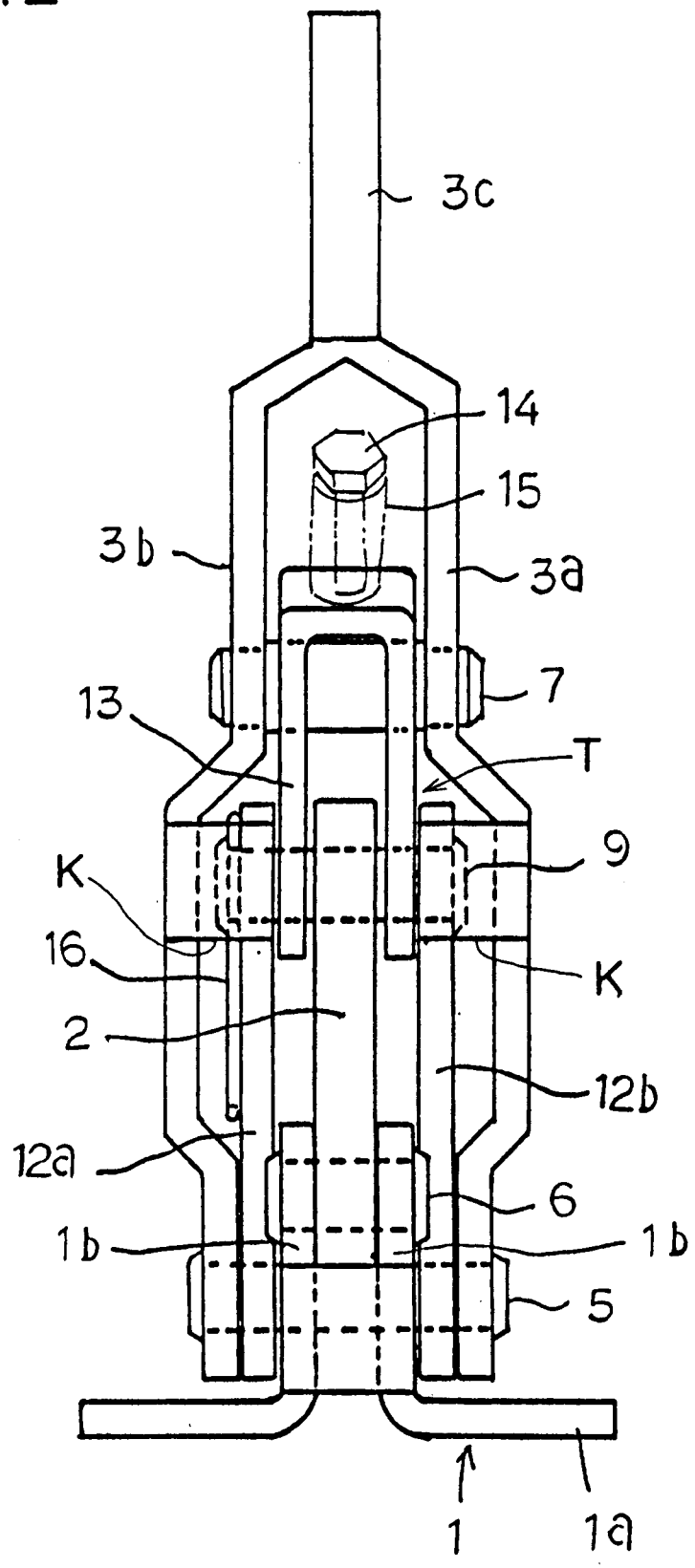
FIG. 2 is a rear view of the clamping device shown in FIG. 1A.
Figure 3:
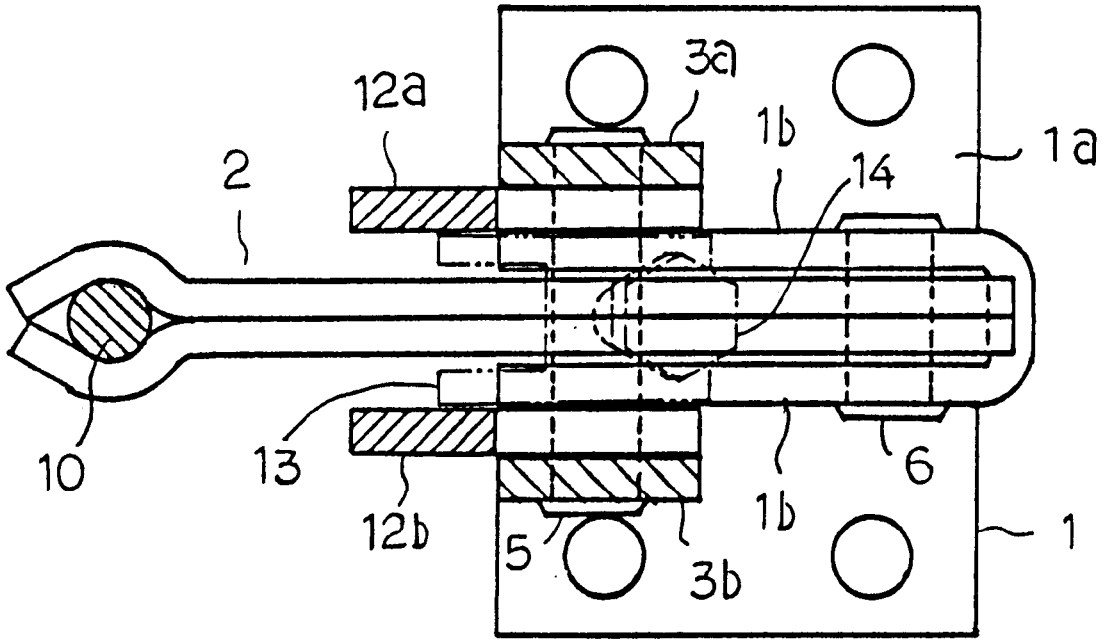
FIG. 3 is a view taken along line III—III in FIG. 1.

The preferable shape of the guide path 2*a* is an arc, as shown in FIG. 1C, passing through the center of the output member 9 with a radius R from a point O positioned at the left (fore) side in FIG. 1C of a line L between the shaft 5 of the operating lever 3 and the output member 9 in a state where the pressing member 10 abuts against the workpiece W. Supposing an arc passing through the center of the output member 9 with a radius Ro from the shaft 5 of the operating lever 3, it is necessary that a part of the arc of radius R is positioned at the fore side of the line L positions higher than the arc of radius Ro, while a part of the arc of radius R is positioned at the rear side of the line L positions lower than the arc of radius Ro. The inside edge of the guide path 2*a* may be notched with a depth of about 0.5 mm so that steady contact with the output member 9 is obtained.

An example of the use and operation of the product of the present invention constructed as above will be described below.

If the operating lever 3 is pull down in the direction of arrow f with no load applied to the clamp arm 2, then the output member 9 displaces the clamp arm 2 upward around the shaft 6 as shown in FIG. 1B while traveling in the same direction f inside the guide path 2*a* with its position relative to the operating lever 3 kept as shown in FIG. 1A. If the operating lever 3 is pulled up in the direction of arrow f1, then the output member 9 displaces the clamp arm 2 downward around the shaft 6 as shown in FIG. 1A while traveling in the same direction f1 inside the guide path 2*a* with its position relative to the operating lever 3 being maintained as shown in FIG. 1A.

In use, the device is installed according to the conventional manner. In fixing the workpiece W, the operating lever 3 is operated in the direction of arrow f to displace upward the forefront portion of the clamp arm 2, and the workpiece W is placed on the support base S in this state.

Subsequently, the operating lever 3 is operated with a relatively small force in the direction of arrow f1. By this operation, the clamp arm 2 is displaced downward. When the pressing member 10 abuts against the workpiece as shown in FIG. 1A, the output member 9 cannot be displaced any further in the guide range of the guide path 2*a*, and consequently the operating lever 3 is restrained so as not to be displaced any more.

Next, the toggle mechanism T in the state of FIG. 1A is operated, for which a stronger operating force is applied to the operating lever 3 in the same direction f1. By this operation, the operating lever 3 pivots around the shaft 5 despite the fact that the first link members 12*a* and 12*b* hardly pivot, so that the output member 9 moves slightly rearward from a line connecting the shaft 5 and the shaft 7.

During this movement, the second link member 13 strongly presses downward the output member 9 by the toggle effect of the toggle mechanism T. In this stage, the second link member 13 receives a reaction force from the output member 9. If this reaction force becomes greater than the elastic force of the Belleville springs 15, then the Belleville springs 15 are compressed, so that the second link member 13 moves to retreat in the direction of the reaction force. Consequently, the output member 9 reaches a position slightly rearward of the line connecting the shaft 5 and the shaft 7 without generating any excessive stress on each member. And, the engagement portion k is engaged with the first link members 12*a* and 12*b*, thereby stably maintaining their positions.

When releasing the fixation of the workpiece W, the operating lever 3 is strongly pulled in the direction of arrow f, whereby each member operates reversely to the foregoing operation to restore the output member 9 to the state shown in FIG. 1A. After this restoration, the operating lever 3 is pull down as shown in FIG. 1B in the direction of arrow f with a relatively small operating force.

If the workpiece W is replaced by another workpiece of a different height and the operating lever 3 is operated in the direction of arrow f1, then the pressing member 10 abuts against the workpiece when the output member 9 is located in a position that is related to the height of the workpiece and is different from the position shown in FIG. 1. Subsequently, by operating the toggle mechanism T similar to the foregoing case, the fixation of the workpiece is released.

When the clamp arm 2 completely presses the workpiece W, the compressive force is varied in a stepless manner by varying compressive elasticity of the Belleville spring 15 with a turning operation of the bolt 14.

Although the operation of the clamp arm 2 is utilized for compressing the workpiece W in the aforementioned embodiment, the present invention is not limited to this. It is acceptable to utilize the operation for putting the workpiece under tension and arbitrarily vary the direction of compression or tension.

What is claimed is:

1. A clamping device comprising:

a base member;

a clamp arm pivotally mounted on a specified portion of said base member;

an operating lever pivotally mounted on a specified portion of said base member for pivotally operating said clamp arm;

a toggle mechanism provided for operation in connection with said operating lever, said toggle mechanism including a first link member pivotally mounted on said base member so that said toggle mechanism can pivot substantially concentrically with said operating lever, a second link member pivotally mounted on said operating lever, and an output member linking said first and second link members with each other such that said link members are able to pivot around said output member, wherein said clamp arm is formed with a guide path that intersects a direction in which said clamp arm pivots so that said output member of said toggle mechanism is guided along the guide path; and elastic means for urging said first and second link members and said output member in a specified pivotal direction.

2. A clamping device as claimed in claim 1, wherein, when said second link member receives a pressure force of not smaller than a specified magnitude from said output member, said second link member, linked with said output member, retreats in a direction in which a pressure force is directed against an elastic force of said elastic means.

3. A clamping device as claimed in claim 1, wherein said elastic means comprises a Belleville spring.

4. A clamping device as claimed in claim 1, further comprising a pressing member connected to a free end of said clamp arm.

5. A clamping device comprising:

a base member;

a clamp arm pivotally mounted on a specified portion of said base member;

an operating lever pivotally mounted on a specified portion of said base member for pivotally operating said clamp arm;

a toggle mechanism provided for operation in connection with said operating lever, said toggle mechanism including a first link member pivotally mounted on said base member so that said toggle mechanism can pivot substantially concentrically with said operating lever, a second link member pivotally mounted on said operating lever, and an output member linking said first and second link members with each other such that said link members are able to pivot around said output member, wherein said clamp arm is formed with a guide path that intersects a direction in which said clamp arm pivots so that said output member of said toggle mechanism is guided along the guide path; and a biasing assembly connected to said second linking member for biasing said first and second link members and said output member in a specified pivotal direction.

6. A clamping device as claimed in claim 5, wherein, when said second link member receives a pressure force of not smaller than a specified magnitude from said output member, said second link member, linked with said output member, retreats in a direction in which a force is directed against a biasing force provided by said biasing assembly.

7. A clamping device as claimed in claim 5, wherein second linking member is U-shaped, and said biasing assembly comprises bolt threaded through an opening formed in said second linking member and a spring disposed in a compressed state between a head of said bolt and a surface of said second linking member.

8. A clamping device as claimed in claim 5, further comprising a pressing member connected to a free end of said clamp arm.

* * * * *